US005401164A

United States Patent [19]

Yen

[11] Patent Number: 5,401,164

[45] Date of Patent: Mar. 28, 1995

[54] GAS BURNER

[75] Inventor: Chia-Hsi Yen, Taichung Hsien, Taiwan, Prov. of China

[73] Assignee: Tri Square Industrial Co., Ltd., Taichung Hsien, Taiwan, Prov. of China

[21] Appl. No.: 181,678

[22] Filed: Jan. 14, 1994

[51] Int. Cl.[6] ..... F23D 14/62

[52] U.S. Cl. ..... 431/354; 431/278; 431/284; 126/39 R; 239/561

[58] Field of Search ..... 431/284, 281, 354, 278, 431/355, 285, 198, 200, 195, 264, 196; 126/39 R, 39 E, 39 BA, 39 K, 39 J; 239/560, 561, 568, 556, 557

[56] References Cited

U.S. PATENT DOCUMENTS

| | | | |
|---|---|---|---|
| 2,037,400 | 4/1936 | Tschierschwitz | 126/39 R |
| 3,606,612 | 9/1971 | Reid, Jr. | 431/281 |
| 4,968,246 | 11/1990 | Sasada et al. | 431/354 |
| 5,197,872 | 3/1993 | Martinez | 431/284 |
| 5,277,576 | 1/1994 | Hartung et al. | 126/39 R |

*Primary Examiner*—James C. Yeung
*Attorney, Agent, or Firm*—Christie, Parker & Hale

[57] ABSTRACT

A gas burner includes several length-adjustable outer gas delivery pipes interposed between an annular outer gas outlet member and a head seat, and a length-adjustable inner gas delivery pipe interposed between an inner gas outlet member and the head seat.

5 Claims, 4 Drawing Sheets

GAS BURNER

BACKGROUND OF THE INVENTION

1. Field of the Invention

This invention relates to a gas burner, more particularly to a gas burner which has several length-adjustable gas delivery pipes.

2. Description of the Related Art

A conventional gas burner includes an inner gas outlet member, an outer gas outlet member, a gas supply pipe unit equipped with two nozzles, an inner gas delivery pipe interposed between the gas supply pipe unit and the inner gas outlet member, and an outer gas delivery pipe interposed between the gas supply pipe unit and the outer gas outlet gas outlet member. In order to achieve effective mixture of combustible gas and enough air in the inner and outer gas delivery pipes, it is necessary for the inner and outer gas delivery pipes to have a ratio of length to diameter of about 6 to 10. The conventional gas burner suffers from the following disadvantages:

(1) Because only one outer gas delivery pipe is provided between the gas supply pipe unit and the outer gas outlet member of the conventional gas burner, the outer gas delivery pipe is relatively long, resulting in increased height of the burner head.

(2) Air can access the spaces between the gas supply pipe unit and the inner gas delivery pipe and between the gas supply pipe unit and the outer gas delivery pipe through a relatively long air passage in the conventional gas burner, so the amount of air mixed with the combustible gas coming from the gas supply pipe unit is insufficient to gain a satisfactory burning effect.

(3) The positions of the nozzles in the gas burner cause difficulties in adjusting or replacing the nozzles. In particular, the majority of the gas burner must be disassembled before adjusting or replacing the nozzles.

(4) The amount of air needed to mix with different types of gas in the gas burner falls into three different ranges. Because the distances between the nozzles and the outer gas delivery pipes and between the nozzles and the inner gas delivery pipe are fixed, the conventional gas burner can be used with only one of liquefied petroleum gas, natural gas, or city gas.

SUMMARY OF THE INVENTION

An object of this invention is to provide a highly efficient gas burner with several gas delivery pipes which are shorter than those of prior art gas burners.

Another object of this invention is to provide a gas burner in which the distances between the gas supply pipe unit and the inner gas delivery pipe and between the gas supply pipe unit and the outer gas delivery pipe are adjustable so as to use with a gas selected from liquefied petroleum gas, natural gas, or city gas.

Still another object of this invention is to provide a gas burner with replaceable nozzles so as to use with a gas selected from liquefied petroleum gas, natural gas, or city gas.

According to this invention, a gas burner includes an inner gas outlet member, an inner gas delivery pipe disposed under the inner gas outlet member, an annular outer gas outlet member, several outer gas delivery pipes disposed under the outer gas outlet member, a head seat disposed under the inner and outer gas delivery pipes and including a first gas supply pipe and a second gas supply pipe, several first nozzles installed on the first gas supply pipe, a second nozzle installed on the second gas supply pipe, and an air inlet unit formed in the outer surface of the gas burner between the outer gas outlet member and the head seat.

The inner gas outlet member has a plurality of inner gas outlets formed therein. The inner gas delivery pipe has an inlet, an outlet communicated with the inner gas outlets, two interconnected tubular sections movable relative to each other so as to adjust the length of the inner gas delivery pipe, and a locking unit for releasably interlocking the tubular sections. The outer gas outlet member has a plurality of outer gas outlet formed therein. Each of the outer gas delivery pipes has an inlet, an outlet communicated with the outer gas outlets, two interconnected tubular sections movable relative to each other so as to adjust the length of the outer gas delivery pipe, and a locking unit for releasably interlocking the tubular sections of the outer gas delivery pipe. A head seat includes a first gas supply pipe accepting the combustible gas from a gas supply source, and a second gas supply pipe connected securely to the first gas supply pipe so as to accept the combustible gas from a gas supply source. The first nozzles are mounted removably on the first gas supply pipe and are spaced apart from the inlets of the outer gas delivery pipes respectively so as to direct the combustible gas from the first gas supply pipe to the inlets of the outer gas delivery pipes. Each of the first nozzles is associated with a corresponding one of the outer gas delivery pipes to define a first air mixing space therebetween. The second nozzle is mounted removably on the second gas supply pipe and is spaced apart from the inlet of the inner gas delivery pipe so as to direct the combustible gas from the second gas supply pipe to the inlet of the inner gas delivery pipe. The second nozzle and the inner gas delivery pipe together define a second air mixing space therebetween. The air inlet unit is communicated with the first and second air mixing spaces. The combustible gas coming from the first and second nozzles is mixed with air in the first and second air mixing spaces, and flows out of the inner and outer gas outlet members through the inner and outer gas delivery pipes.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
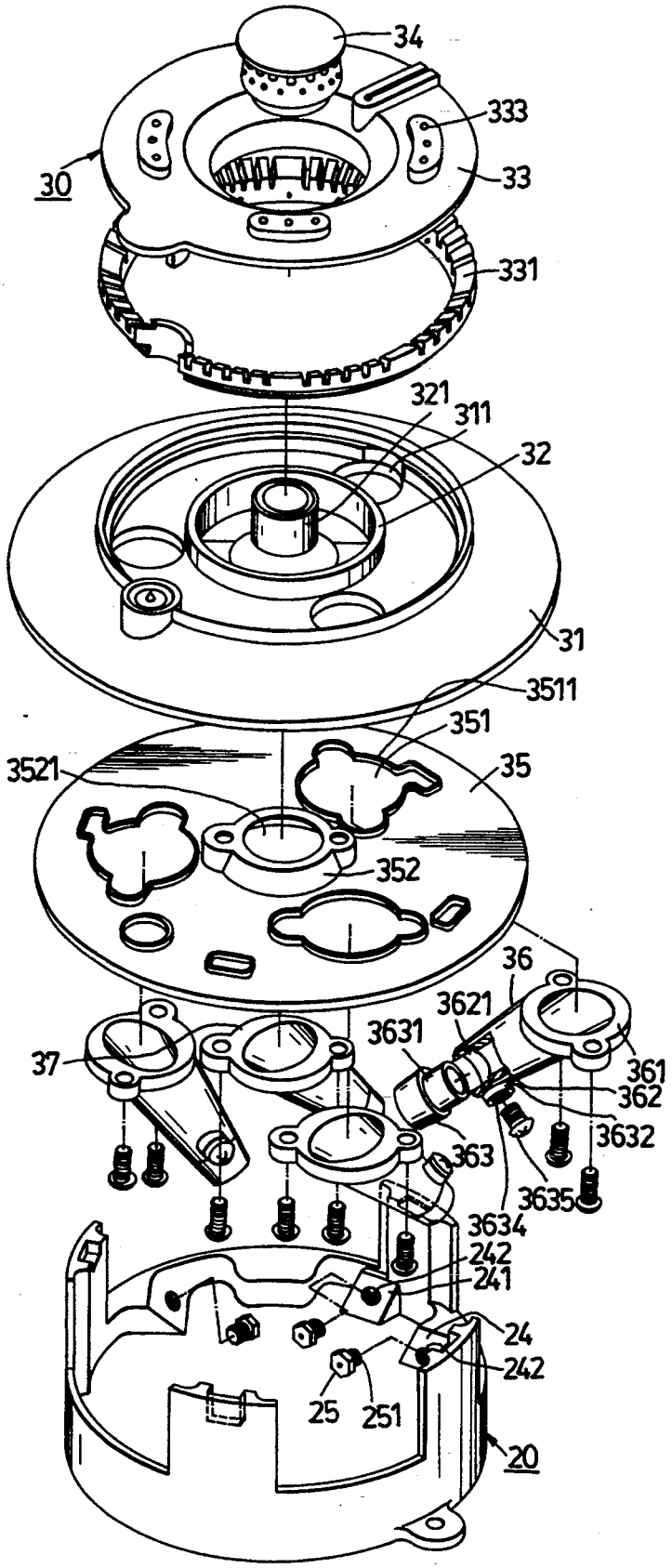
FIG. 1 is an exploded view showing the first embodiment of a gas burner according to this invention.
Figure 2:
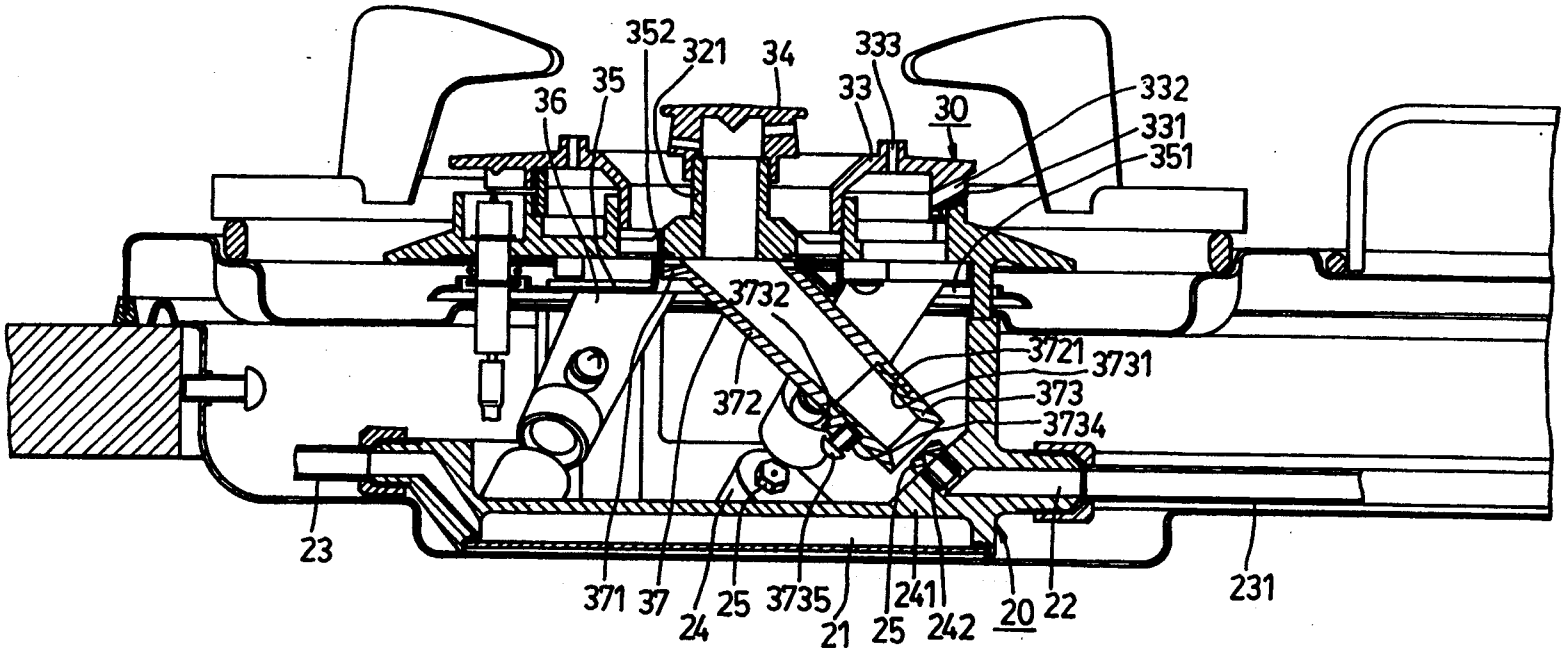
FIG. 2 is a sectional view showing the first embodiment of this invention.
Figure 3:
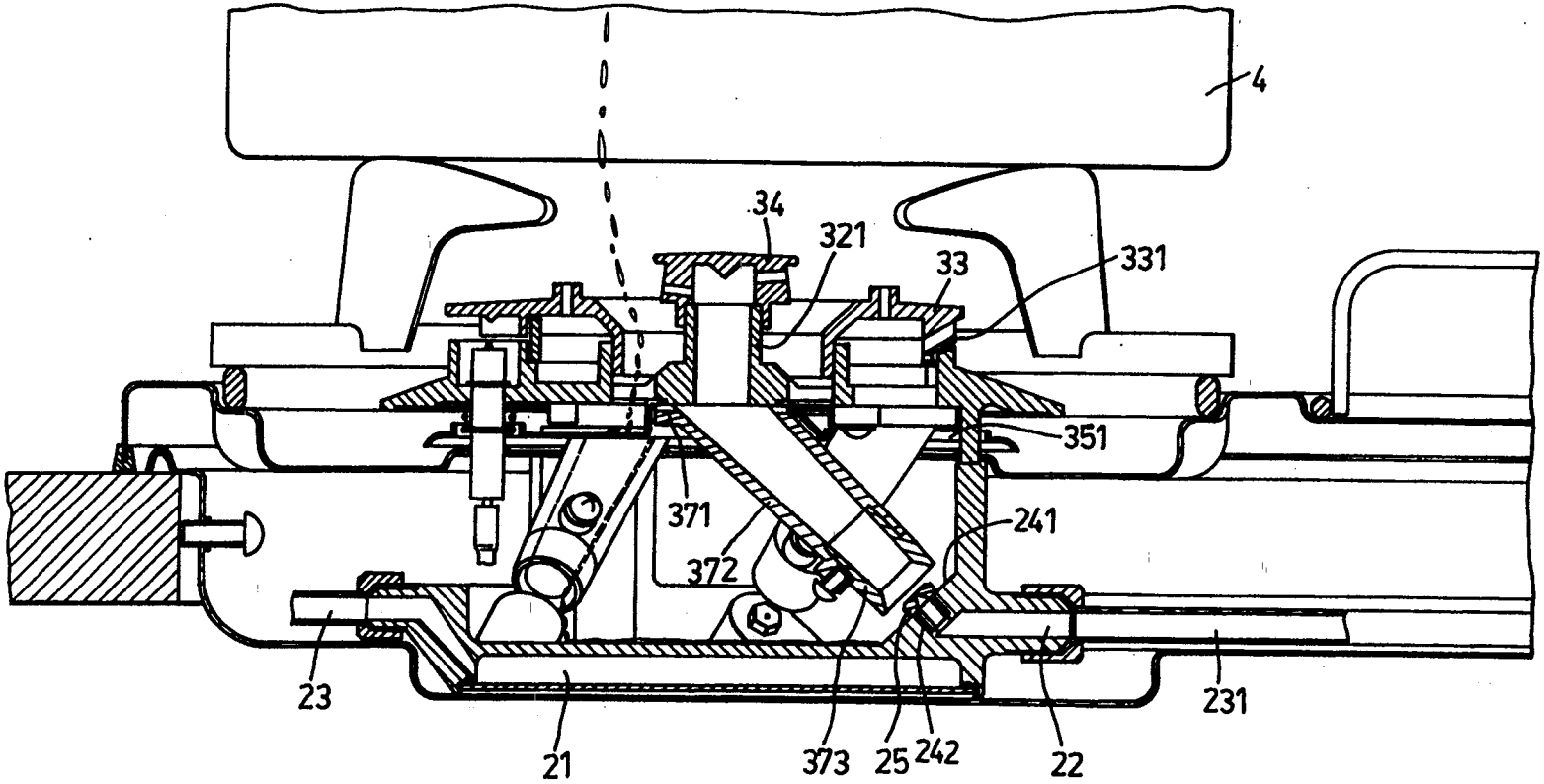
FIG. 3 is a schematic view illustrating the use of the first embodiment of this invention.

Referring to FIGS. 1 and 2, the first embodiment of the gas burner of this invention includes a molded head seat (20) and a burner head unit (30).

The head seat (20) includes a gas supply pipe unit consisting of a fixed first gas supply pipe (21) and a fixed second gas supply pipe (22) which are connected to a gas supply source via connecting pipes (23, 231). The first gas supply pipe (21) has three projections (24) each of which has an outlet (241). The second gas supply pipe (21) has a projection (24) which has an outlet (241). Three inclined first nozzles (25) have externally threaded ends (251) engaged within the threaded holes (242) of the projections (24) of the first gas supply pipe (21). An inclined second nozzle (25) is mounted removably on the second gas supply pipe (22) in the same manner as the first nozzles (25).

The burner head unit (30) includes an annular outer support (31) with three circular soup holes (311) formed therethrough, and an annular inner support (32) connected securely to the outer support (31). The inner support (32) has a fixed vertical pipe (321) at the center thereof. An annular outer gas outlet member (33) is placed on a support ring (331) which is positioned on the outer support (31). Much space is left between the outer gas outlet member (33) and the support ring (331) so as to form an air inlet unit (332). A plurality of outer gas outlets (333) are formed through the outer gas outlet member (33) in communication with the air inlet unit (332) through which air can enter the gas burner. An inner gas outlet member (34) is placed on the vertical pipe (321) of the inner support (32) and is surrounded by the outer gas outlet member (33). A soup tray (35) is disposed between the head seat (20) and the outer support (31) and between the head seat (20) and the inner support (32), and includes three holes (351) formed therethrough, and a securing projection (352) with a central hole (3521) formed therethrough. Each of the holes (351) is defined by an annular upward flange (3511) which prevents the soup falling from a pot (4) from flowing out of the tray (35). Three inclined outer gas delivery pipes (36) have upper ends secured to the outer support (31) in such a manner that the interiors of the outer gas delivery pipes (36) are respectively communicated with the soup holes (311). An inclined inner gas delivery pipe (37) is secured to the soup tray (35) in such a manner that the interior of the inner gas delivery pipe (37) is communicated with the central hole (3521) of the soup tray (35).

Each of the outer gas delivery pipes (36) has a fastening end (361) secured to the outer support (31) in such a manner that an air-tight seal is established therebetween, a fixed tubular section (362) connected securely to the fastening end (361), and a movable tubular section (363) having an upper end engaged within the increased-inner-diameter lower end (3621) of the fixed tubular section (362). The fixed tubular section (362) has a radial projection (3632) protruding outward from the peripheral wall thereof, through which a threaded hole (3634) is formed so that the movable tubular section (363) can be locked on the fixed tubular section (362) by means of a lock bolt (3635), thereby adjusting the length of the outer gas delivery pipe (36). The radial projection (3632), the threaded hole (3634), and the lock bolt (3635) together constitute a locking unit for releasably locking the movable tubular section (363) on the fixed tubular section (362). Similarly, the inner gas delivery pipe (37) includes a fastening end (371), a fixed tubular section (372) with an increased-inner-diameter lower end (3721), a movable tubular section (373), a radial projection (3732) with a threaded hole (3734), and a lock bolt (3735). Each of the outer and inner gas delivery pipes (36, 37) has an inlet at the lower end thereof, and an outlet at the upper end. The inlet of each of the outer and inner gas delivery pipes (36, 37) is spaced apart from a corresponding one of the nozzles (25) at a certain distance which is determined according to the type of the combustible gas supplied from the first and second gas supply pipes (21, 22). A first air mixing space is defined between the inlet of each of the outer gas delivery pipes (36) and the corresponding nozzle (25). A second air mixing space is defined between the inlet of the inner gas delivery pipe (37) and the corresponding nozzle (25). As shown in FIG. 2, the first and second air mixing spaces are communicated with the air inlet unit (332).

When the type of the combustible gas is changed, the burner head unit (30) is removed from the head seat (20) so as to replace the nozzles (25) and to adjust the lengths of the outer and inner gas delivery pipes (36, 37), thereby adjusting the distances between the gas supply pipe unit and the gas delivery pipes (36, 37).

In comparison with the prior art, because the number of the outer gas delivery pipes (36) is increased, the amount of air needed to mix with the combustible gas in each of the pipes (36) and between the inlet of each of the pipes (36) and the corresponding nozzle (25) is much reduced. Accordingly, in a case where the ratio of length to diameter of the outer and inner gas delivery pipes (36, 37) is about 6 to 10, the lengths of the outer and inner gas delivery pipes (36, 37) are much reduced so that the height of the gas burner of this invention is reduced and that the distances from the air inlet unit (332) to the inlets of the outer and inner gas delivery pipes (36, 37) are reduced, thereby achieving quick supplement of air into the gas burner.

Figure 4:
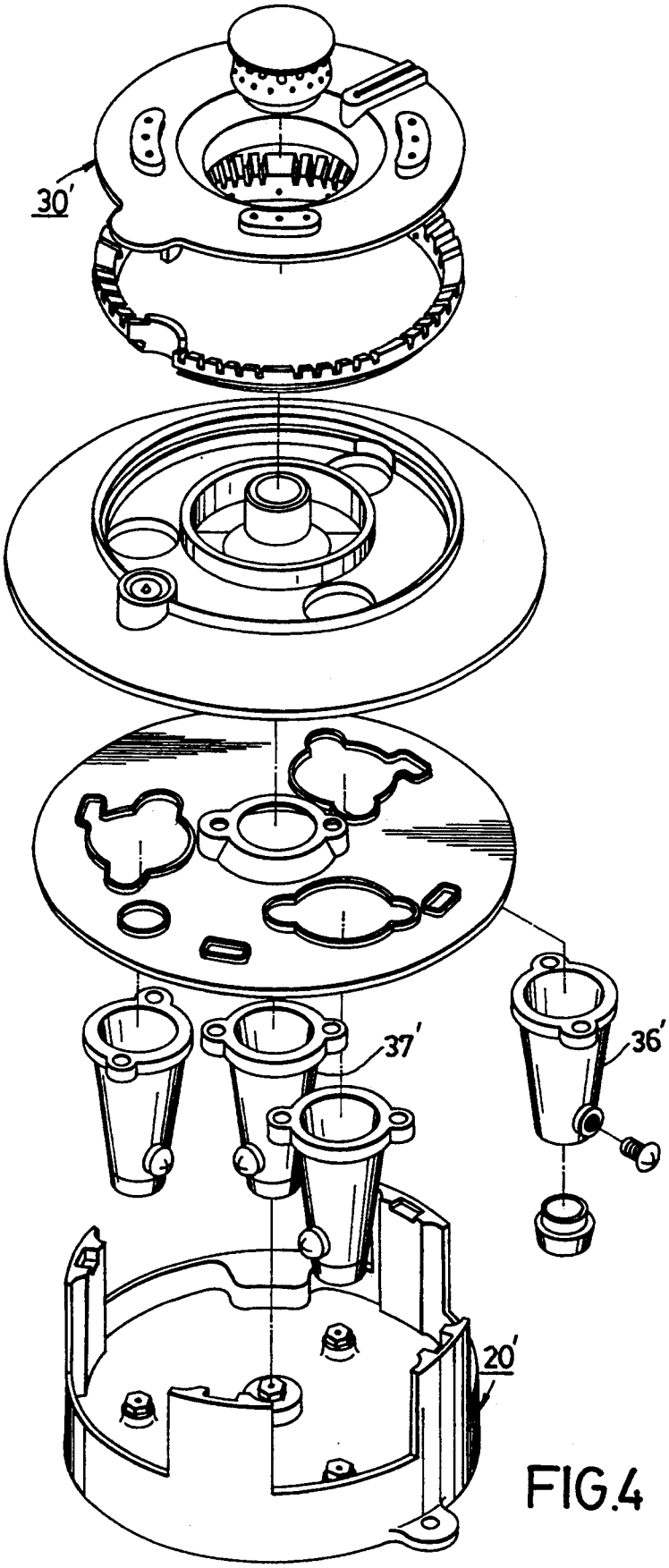
FIG. 4 is an exploded view showing the second embodiment of the gas burner of this invention.

FIG. 4 shows the second embodiment of the gas burner of this invention. Unlike the previous embodiment, the burner head unit (30') includes three vertical outer gas delivery pipes (36') and a vertical inner gas delivery pipe (37') which are respectively aligned with the vertical nozzles (25') of the head seat (20').

With this invention thus explained, it is apparent that numerous modifications and variations can be made without departing from the scope and spirit of this invention. It is therefore intended that this invention be limited only as indicated in the appended claims.

I claim:

1. A gas burner comprising:

an inner gas outlet member with a plurality of inner gas outlets formed therein;

an inner gas delivery pipe disposed under the inner gas outlet member and having an inlet, an outlet communicated with the inner gas outlets, two interconnected tubular sections movable relative to each other so as to adjust length of the inner gas delivery pipe, and a locking unit for releasably interlocking the tubular sections;

an annular outer gas outlet member with a plurality of outer gas outlets formed therein;

several outer gas delivery pipes disposed under the outer gas outlet member, each of the outer gas delivery pipes having an inlet, an outlet communicated with the outer gas outlets, two interconnected tubular sections movable relative to each other so as to adjust length of the outer gas delivery pipe, and a locking unit for releasably interlocking the tubular sections of the outer gas delivery pipe;

a head seat disposed under the inner and outer gas delivery pipes and including a first gas supply pipe adapted to accept a combustible gas from a gas supply source, and a second gas supply pipe connected securely to the first gas supply pipe and adapted to accept the combustible gas from the gas supply source;

several first nozzles installed on the first gas gas supply pipe and spaced apart from the inlets of the outer gas delivery pipes respectively so as to direct the combustible gas from the first gas supply pipe to the inlets of the outer gas delivery pipes, each of the first nozzles being associated with a corresponding one of the outer gas delivery pipes to define a first air mixing space therebetween;

a second nozzle installed on the second gas supply pipe and spaced apart from the inlet of the inner gas delivery pipe so as to direct the combustible gas from the second gas supply pipe to the inlet of the inner gas delivery pipe, the second nozzle and the inner gas delivery pipe together defining a second air mixing space therebetween; and a burner head unit coupled with and disposed above the inner and outer gas delivery pipes and having an air inlet unit which is formed in an outer surface of the burner head unit between the outer gas outlet member and the head seat in communication with the first and second air mixing spaces;

whereby, the combustible gas coming from the first and second nozzles is mixed with air in the first and second air mixing spaces, and flows out of the inner and outer gas outlet members through the inner and outer gas delivery pipes.

2. A gas burner as claimed in claim 1, wherein each of the inner and outer gas delivery pipes is vertical.

3. A gas burner as claimed in claim 1, wherein each of the inner and outer gas delivery pipes is inclined.

4. A gas burner as claimed in claim 1, wherein the first nozzles are mounted removably on the first gas supply pipes respectively, the second nozzle being mounted removably on the second gas supply pipe.

5. A gas burner as claimed in claim 1, wherein the first nozzles are engaged threadably with the first gas supply pipes respectively, the second nozzle being engaged threadably with the second gas supply pipe.

* * * * *